United States Patent [19]

Sternling

[11] Patent Number: 4,959,080

[45] Date of Patent: Sep. 25, 1990

[54] PROCESS FOR GASIFICATION OF COAL UTILIZING REACTOR PROTECTED INTERALLY WITH SLAG COALESCING MATERIALS

[75] Inventor: Charles V. Sternling, Houston, Tex.

[73] Assignee: Shell Oil Company, Houston, Tex.

[21] Appl. No.: 372,806

[22] Filed: Jun. 29, 1989

[51] Int. Cl.[5] ..... C10J 3/46; C10J 3/72

[52] U.S. Cl. ..... 48/210; 48/203; 48/206; 48/DIG. 2; 252/373

[58] Field of Search ..... 48/203, 206, 210, DIG. 2, 48/77; 252/373; 110/347; 264/30

[56] References Cited

U.S. PATENT DOCUMENTS

| | | | |
|---|---|---|---|
| 4,473,379 | 9/1984 | Liu | 48/DIG. 2 |
| 4,802,894 | 2/1989 | Usami et al. | 48/210 |
| 4,805,561 | 2/1989 | Davis et al. | 48/210 |
| 4,805,562 | 2/1989 | Davis et al. | 48/210 |
| 4,818,224 | 4/1989 | Geesen et al. | 264/30 |
| 4,823,741 | 4/1989 | Davis et al. | 48/210 |
| 4,823,742 | 4/1989 | Davis et al. | 48/210 |

FOREIGN PATENT DOCUMENTS

| | | | |
|---|---|---|---|
| 0160738 | 2/1984 | Fed. Rep. of Germany | 48/210 |

*Primary Examiner*—Peter Kratz

*Attorney, Agent, or Firm*—Albert J. Adamcik

[57] ABSTRACT

A process and reaction for the gasification of coal disclosed, the invention being characterized by the provision in each of a plurality of layers of slag coalescing materials on the inner liner of the reactor to provide a protective coating on the wall or walls of the reactor.

6 Claims, 1 Drawing Sheet

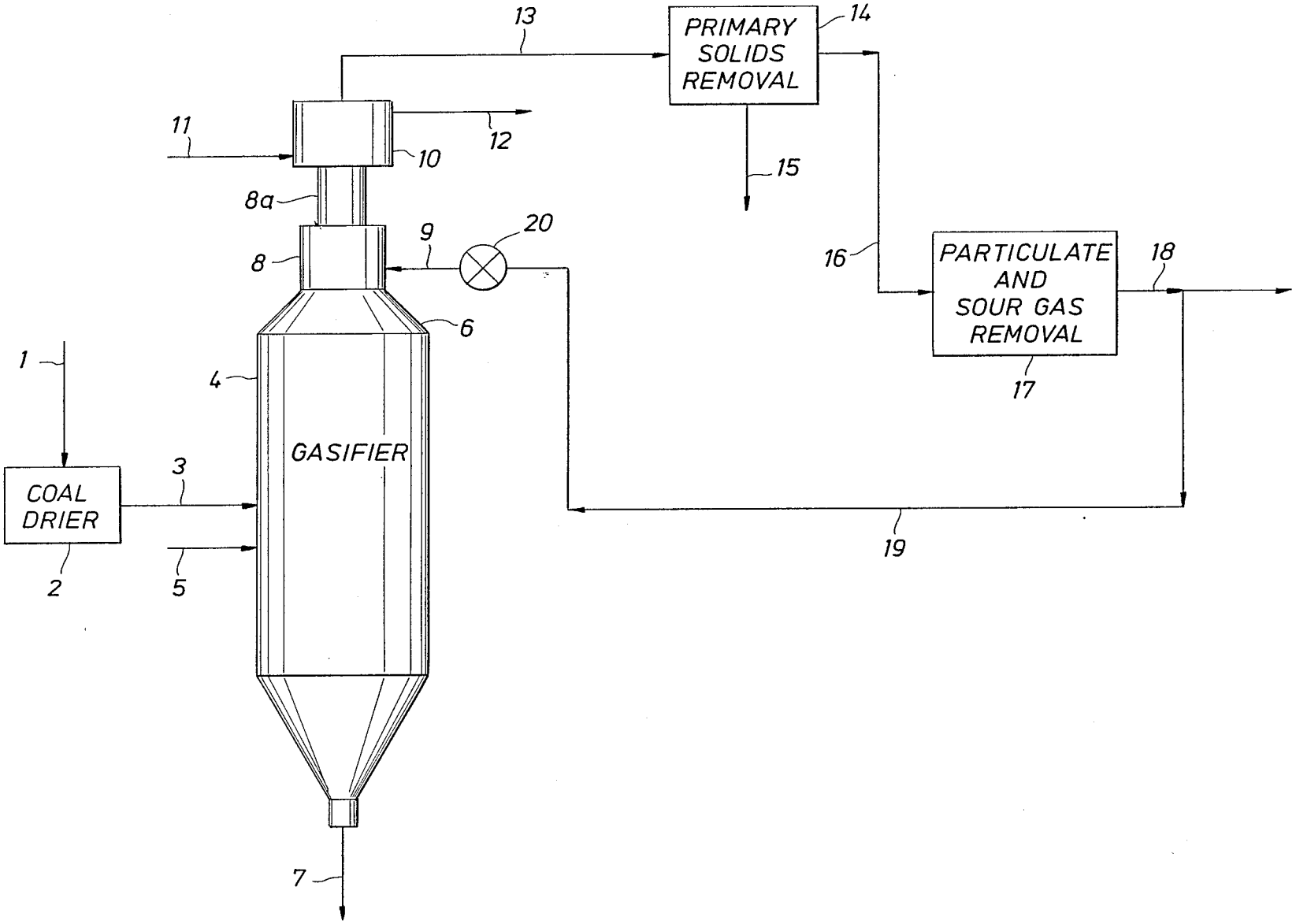
PARTICULATE AND SOUR GAS REMOVAL
PRIMARY SOLIDS REMOVAL
GASIFIER
COAL DRIER
1
2
3
4
5
6
7
8
8a
9
10
11
12
13
14
15
16
17
18
19
20

PROCESS FOR GASIFICATION OF COAL UTILIZING REACTOR PROTECTED INTERALLY WITH SLAG COALESCING MATERIALS

BACKGROUND OF THE INVENTION

Partial combustion or gasification of coal involves reaction of the coal at elevated temperatures, and possibly elevated pressures, with a limited volume of oxygen, the reaction preferably being carried out in a reactor or reaction chamber or vessel into which coal is fed by means of "burners" together with additional agents such as steam, carbon dioxide, or various other materials. Gasification of coal produces a gas, known as synthesis gas, that contains mostly carbon monoxide and hydrogen. Also produced are varying minor quantities of other gases, such as carbon dioxide and methane, and, at least with some coals, various heavier materials, such as small sticky or molten particles. The sticky or molten particles are principally alumina-silica minerals present in the coal, and depending on their size and character, are recovered in different ways. In at least one coal gasification process undergoing development, the design of the gasifier is such that a rough separation of the molten particles takes place in the gasifier vessel or reaction space chamber. That is, the heavy particles tend to remain or drop to the bottom of the gasifier vessel to a slag recovery area or bath, and lighter and molten particles are partly deposited by turbulence on the walls of the vessel and partly carried by the synthesis gas upward and out of the reactor chamber into a quench zone which is mounted generally above the gasifier, and wherein a cool quench gas is employed to quench the gas and particles. Nevertheless, the solidified material, because it is derived from a "reducing" atmosphere, may be different in composition and properties from flyash or slag normally associated with combustion boilers, wherein a fully oxidizing atmosphere is utilized. For example, the slag from processes from partial combustion of coal may contain elemental iron, a component not normally associated with boiler slag.

An important aspect of coal gasification processes is the recovery of great quantities of heat, preferably in the form of high grade steam. While the gasifier vessel might appear to be the appropriate location for this recovery, in fact, the case is otherwise. For example, in those cases where the gasification is carried out utilizing burners in an enclosed vessel, the heat of the gasification reaction is so intense that insulating liner materials must be utilized to protect the vessel walls. The designer is thus faced with this dilemma: if heat exchange is too great, the gasification zone will be too cool for good gasification, and the efficiency of the reaction will suffer, while if heat exchange is insufficient, i.e., if heat is allowed to build up, the materials of the gasification zone wall or walls will begin to suffer damage, particularly from combination of high temperature and the reactive components in the synthesis gas.

To overcome this problem, liners, such as those described in U.S. Pat. No. 4,818,224, and suitably treated as specified therein, may be employed. However, the liners are also attacked by the highly corrosive combustion gases and by the molten mineral particles. The invention addresses this problem in a unique manner.

SUMMARY OF THE INVENTION

Accordingly, the invention relates to a process, and a reactor vessel, for the gasification of coal or similar carbonaceous material in which the surface of the liner defining the reaction zone or reaction space is coated or lined with at least two contiguous layers of slag coalescing materials, the layers of materials being arranged in order of increasing melting point of the respective materials towards the internal reaction space of the reactor vessel. That is, the slag coalescing materials will be layered in such manner that the melting points of the layers of coalescing materials increase in the direction of the internal reaction space. It is an object of the invention that, by providing the layers in this fashion, the slag particles from the combustion reaction coalesce with the layers and form deposits that adhere moderately to the liner or internal wall surface or surfaces of the vessel, thereby protecting the internal wall surface or wall surfaces from damage. After sufficient slag is deposited, an equilibrium will be established in which additional depositing slag will remain molten and flow because of gravity to a lower portion of the reaction zone or vessel.

DETAILED DESCRIPTION OF THE INVENTION

The layers of the slag coalescing material may vary in thickness, as will be appreciated by those skilled in the art, but will preferably range from 0.1 mm to 20 mm, preferably 1 mm to 3 mm. The layers provided will vary in melting point (or range of melting point if the melting point is not precise), as noted. Preferably, the melting point or range of melting point of the layer touching the liner will be from about 500° C. to about 750° C., with a melting point or range of melting point from about 750° C. to about 1600° C. for the next layer or layers toward the reaction space. Preferably, the "second" layer, i.e., that contiguous to the first layer will have a melting point in the range of from about 750° C. to about 1400° C., and a "third" layer will have a melting point or range of melting point from about 1400° C. to about 1600° C. at the surface in contact with the combustion gases. As many layers as desired may be utilized, subject to the heat flow considerations mentioned.

Those skilled in the art may select suitable slag coalescing materials. As used herein, the term "slag coalescing material" or variants thereof simply refers to materials or compositions which will blend with the slag from the coal to form lower melting point mixtures or compositions which will tend to adhere to the internal wall surfaces. Suitable substances include materials referred to loosely as fluxes, and include boron oxide (mpt. 577° C.), sodium borate (mpt. 741° C.), mixtures of borate and cryolite, mixtures of cryolite and fluospar (mpt 900° C. to 1000° C.), and anorthite ($CaO.Al_2O_3.2\ SiO_2$) (mpt. 1550° C.).

The partial combustion of coal to produce synthesis gas, which is substantially carbon monoxide and hydrogen, and particulate flyslag, is well known, and a survey of known processes is given in "*Ullmanns Enzyklopadie Der Technischen Chemie*", vol. 10 (1958), pp. 360–458. Several such processes for the preparation of hydrogen and carbon monoxide, flyslag gases are currently being developed. Accordingly, details of the gasification process are related only insofar as is necessary for understanding the present invention.

In general, the gasification is carried out by partially combusting the coal with a limited volume of oxygen at a temperature normally between about 1050° C. and about 2000° C. If a temperature of between 1050° C. and 2000° C. is employed, the product gas may contain very small amounts of side products such as tars, phenols and condensables hydrocarbons, as well as the molten or sticky particles mentioned. Suitable coals include lignite, bituminous coal, sub-bituminous coal, anthracite coal, and brown coal. In order to a achieve a more rapid and complete gasification, initial pulverization of the coal is preferred. Particle size is preferably selected so that 70% of the solid coal feed can pass a 200-mesh sieve. The gasification is preferably carried out in the presence of oxygen and steam, the purity of the oxygen preferably being at least 90% by volume, nitrogen, carbon dioxide and argon being permissible as impurities. If the water content of the coal is too high, the coal should be dried before use. The atmosphere will be maintained reducing by the regulation of the weight ratio of the oxygen to moisture and ash free coal in the range of 0.6 to 1.1, preferably 0.8 to 0.9. The specific details the equipment and procedures employed form no part of the invention, but those described in U.S. Pat. No. 4,350,103 and U.S. Pat. No. 4,458,607, both incorporated herein by reference, may be employed. Although, in general, it is preferred that the ratio between oxygen and steam be selected so that from 0.1 to 1.0 parts by volume of steam is present per part by volume of oxygen, the invention is applicable to processes having substantially different ratios of oxygen to steam. The oxygen used is preferably heated before being contacted with the coal, preferably to a temperature of from about 200° C. to 500° C.

The details of the gasification reactor system, other than the liner and layers of slag coalescing materials specified herein, form no part of the present invention, and suitable reactors are described in British Pat. No. 1501284 and U.S. Pat. No. 4,022,591. The high temperature at which the gasification is carried out is obtained by reacting the coal with oxygen and steam in a reactor at high velocity. A preferred linear velocity is from 10 to 100 meters per second, although higher or lower velocities may be employed. The pressure at which the gasification can be effected may vary between wide limits, preferably being from 10 to 200 bar. Residence times may vary widely., common residence times of from 0.2 to 20 seconds are described, with residence times of from 0.5 to 15 seconds being preferred.

After starting materials have been converted, the reaction product, which has a temperature of between about 1050° C. and about 1800° C., and which comprises hydrogen, carbon monoxide, carbon dioxide, and water, as well as the aforementioned impurities, is passed upward from the reactor. As will be evident, passing the hot synthesis gas containing sticky particles upward from the reactor provides some separation of the synthesis gas and the particles. The upward moving particles will then be solidified, preferably by a quench gas and indirect heat exchange, and the synthesis gas stream with solidified particles then passes on for further cooling and treatment. As indicated, a variety of elaborate techniques have been developed for quenching and cooling the gaseous stream, the techniques in the quench zone and primary heat exchange zone in general being characterized by the use of a quench gas and a boiler in which steam is generated with the aid of the waste heat. The walls of the quench zone, i.e., the external or wall surfaces not in contact with the synthesis gas, and those of the primary heat exchange zone, are cooled with boiling water or steam.

In order to illustrate the invention more fully, reference is made to the accompanying schematic drawing. The drawing is of the process flow type in which auxiliary equipment, such as valves, pumps, holding vessels, etc., have been omitted therefrom. All values are merely exemplary or calculated.

Accordingly, pulverulent coal is passed via line (1) into a coal dryer (2) where the coal is dried, suitably at a temperature of about 200° C. The dry coal is subsequently discharged through a line (3) and passed into a gasification reactor (4) where it is gasified at a temperature of about 1500° C. to about 2000° C., a pressure of about 35 atmospheres absolute, with oxygen, which is supplied through a line (5). The gasification produces a product or synthesis gas containing sticky molten particles which is removed from the lower portion of the reactor via line (7). The gasification product is passed upward via conduit or quench zone (8) where it is quenched by cooled synthesis gas supplied via line (9) and indirect heat exchange with steam, and is then passed via duct **8(*a*) through a boiler or heat exchange zone (10) where it is cooled to a temperature of about 200° C. The inner walls of the gasifier or reactor vessel, which are formed by high temperature heat exchange tubes, are lined, on the reaction zone side, with a liner of a rammed plastic refractory, such as phosphate bonded alumina. The liner surface toward the reaction zone is coated in succession with a 1 mm thick layer of sodium borate, a 1 mm layer of a 1:1 mixture of sodium borate and cryolite, and a 1 mm layer of cryolite. In the heat exchange zone (10), water, which is supplied through line (11), is converted by indirect heat exchange to high pressure steam, the steam being discharged through a line (12). The cooled gasification product is passed through a line (13) to a series of cyclones (14) where the bulk of the particulates (flyslag) is removed and sent via line (15) to storage. The synthesis gas then passes via line (16) to a series of purification steps designated as (17) where a final, cooled product synthesis gas is removed via line (18). A portion of the cooled gas is recycled via line (19) to quench zone (8) for quenching the hot gas from reactor (4)**. A partially cooled, impure gas is removed and utilized (not shown).

While the invention has been illustrated with particular apparatus, those skilled in the art will appreciate that, except where specified, other equivalent or analogous units may be employed. The term "zone," as employed in the specification and claims, includes, where suitable, the use of segmented equipment operated in series, or the division of one unit into multiple units to improve efficiency or overcome size constraints, etc. Parallel operation of units is, of course, well within the scope of the invention.

What is claimed is:

1. A process for the gasification of coal comprising oxidizing coal under conditions to produce hot synthesis gas containing flyslag and having a temperature of from about 1050° C. to about 1800° C., the oxidizing being carried out in a reactor comprising a vessel or tube having an inner reaction space bounded by a wall surface or surfaces protected by a refractory liner between the space and at least a portion of the wall surface or surfaces, the surface of the liner defining the reaction zone of the reactor being coated or lined with at least two contiguous layers of different slag coalescing materials, the layers of materials being arranged in order of increasing melting point of the respective materials toward the internal reaction space of the reactor vessel or tube.

2. The process of claim 1 wherein the layer bounding the reaction space has a melting point up to about 1600° C.

3. The process of claim 1 wherein the melting point or range of melting points of the layer touching the liner is from about 500° C. to about 750° C., and the melting point or range of melting points of the layer or layers toward the internal reaction space is from about 750° C. to about 1600° C.

4. The process of claim 2 wherein the melting point or range of melting points of the layer touching the liner is from about 500° C. to about 750° C., and the melting point or range of melting points of the layer or layers toward the internal reaction space is from about 750° C. to about 1600° C.

5. The process of claim 1 wherein the melting point or range of melting points of the layer touching the liner is from about 500° C. to about 750° C., the melting point or range of melting points of the layer contiguous to the layer touching the liner is from about 750° C. to about 1400° C., and the melting point or range of melting points of a layer bounding the reaction space and touching the layer contiguous to the layer touching the liner is from about 1400° C. to about 1600° C.

6. The process of claim 2 wherein the melting point or range of melting points of the layer touching the liner is from about 500° C. to about 750° C., the melting point or range of melting points of the layer contiguous to the layer touching the liner is from about 750° C. to about 1400° C., and the melting point or range of melting points of a layer bounding the reaction space and touching the layer contiguous to the layer touching the liner is from about 1400° C. to about 1600° C.

* * * * *